US010989370B2

(12) United States Patent
Longarzo et al.

(10) Patent No.: US 10,989,370 B2
(45) Date of Patent: Apr. 27, 2021

(54) DECORATIVE BI-DIRECTIONAL PORTABLE LIGHTING DEVICE

(71) Applicants: Denise Longarzo, Los Angeles, CA (US); Volker Schauz, Los Angeles, CA (US); Donald D. Davis, Los Angeles, CA (US); Kathleen Kennedy Davis, Los Angeles, CA (US)

(72) Inventors: Denise Longarzo, Los Angeles, CA (US); Volker Schauz, Los Angeles, CA (US); Donald D. Davis, Los Angeles, CA (US); Kathleen Kennedy Davis, Los Angeles, CA (US)

( * ) Notice: Subject to any disclaimer, the term of this patent is extended or adjusted under 35 U.S.C. 154(b) by 0 days.

(21) Appl. No.: 16/858,998

(22) Filed: Apr. 27, 2020

(65) Prior Publication Data

US 2020/0340632 A1 Oct. 29, 2020

Related U.S. Application Data

(60) Provisional application No. 62/839,061, filed on Apr. 26, 2019.

(51) Int. Cl.

| | |
|---|---|
| ***F21L 4/02*** | (2006.01) |
| ***F21V 23/04*** | (2006.01) |
| ***F21V 3/02*** | (2006.01) |
| *F21Y 115/10* | (2016.01) |
| *F21Y 113/20* | (2016.01) |

(52) U.S. Cl.

CPC ..... *F21L 4/02* (2013.01); *F21V 3/02* (2013.01); *F21V 23/0414* (2013.01); *F21V 23/0442* (2013.01); *F21V 23/0492* (2013.01); *F21Y 2113/20* (2016.08); *F21Y 2115/10* (2016.08)

(58) Field of Classification Search

CPC ..... F21L 4/02; F21V 3/02; F21V 23/0414; F21V 23/0442

See application file for complete search history.

(56) References Cited

U.S. PATENT DOCUMENTS 6,384,988 B1 5/2002 Muller et al.
6,443,589 B1 * 9/2002 Lee ..... A47G 19/2227 362/101

(Continued)

OTHER PUBLICATIONS

Tekcoplus, 10x with 25mm with LED, Focused Eye Loupe Jewelry Magnifiers for Gems, Hobbies Antiques Models,Interchangeable Reticle Scale, https://www.amazon.com/Focused-Jewelry-Magnifiers-Antiques-Interchangeable/dp/B072R1Q346/ref=sr_1_1?dchild=1&keywords=%2FFocused-Jewelry-Magnifiers-Antiques-Interchangeable&qid=1588009757&sr=8-1, last accessed Apr. 27, 2020.

*Primary Examiner* — Arman B Fallahkhair

(74) *Attorney, Agent, or Firm* — SoCal IP Law Group LLP; Guy Cumberbatch; Steven C. Sereboff

(57) ABSTRACT

There is disclosed a dual-mode lighting device having decorative electronic illumination and optional magnifying device ("lighting device" or "device"). The lighting device incorporates at least two sets of light sources to provide illumination for decorative lighting and for illumination for spot lighting a specific area. The lighting device has a power source, a switch, one or more light sources such as light emitting diodes. The lighting source is bi-directional so that it has the ability to illuminate in both upward and downward direction. An optional lens for magnification expanding across the length and width of the device is housed between the upward and the downward illumination sources.

20 Claims, 5 Drawing Sheets

(56) References Cited

U.S. PATENT DOCUMENTS

| | | | | |
|---|---|---|---|---|
| 7,006,223 | B2 * | 2/2006 | Mullani | A61B 5/0059 356/369 |
| 7,139,136 | B2 | 11/2006 | Waggoner et al. | |
| 8,360,596 | B2 * | 1/2013 | Bertken | F21L 4/022 362/120 |
| 2006/0120080 | A1 * | 6/2006 | Sipinski | A61L 9/037 362/253 |
| 2008/0174987 | A1 | 7/2008 | Mundhra | |
| 2008/0298050 | A1 * | 12/2008 | Elnore | A47G 19/2227 362/154 |
| 2016/0091196 | A1 * | 3/2016 | Chien | F21V 33/0004 362/253 |
| 2016/0153650 | A1 * | 6/2016 | Chien | F21V 33/0004 362/253 |
| 2016/0157645 | A1 | 6/2016 | Bayless | |

* cited by examiner

DECORATIVE BI-DIRECTIONAL PORTABLE LIGHTING DEVICE

RELATED APPLICATION INFORMATION

This patent is a claims priority from provisional patent application 62/839,061, filed Apr. 26, 2019, titled ALTERING BI-DIRECTIONAL PORTABLE LIGHTING DEVICE THAT MAY INCLUDE A MAGNIFYING LENS, which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to an alternating bi-directional portable lighting device that may include a magnifying lens.

Description of the Related Art

Existing decorative light sources like candles (traditional as well as electric) or other low-intensity lighting devices typically offer accent light to set a mood in public or private environments, but have the major problem that the accent light offers too low light intensity to enable persons to read or carry out activities in dark areas. On the other hand, flashlights (solid or the like built in smart phones) or other reading and illumination light sources generally provide for bright, aggressive and non-decorative light intensities and are not engineered as decorative design elements. Often these types of light sources provide one concentrated direction of illumination and are limited in the intensity of illumination.

Often, a candle or side light is placed on a restaurant table. The ambient light is minimal at best but sets a mood. Sitting in a food/bar establishment it is often much too dark to read the menu or wine list, as well as the check and credit card receipt presented at the end of the meal. The font size and lack of light make it near impossible to read without the use of light. Often, the candle is held close to the menu or receipt to try and read/sign. The candle is pulled closer or a phone is pulled from a pocket or purse so that a "flashlight" app can be opened. And, all too often, glasses are left in the car or at home leaving the patron without the ability to read the menu and requiring an employee to recite the various offerings. These options can be inconvenient and frustrating.

Inside the home, light is a necessary tool and it can set a mood. In an emergency, such as an earthquake and/or power outage we need a light that is easily and readily available and accessible, not tucked in a drawer or closet that all too often needs to be located while panicked and/or disoriented in total darkness, and whose batteries have died or are weak.

Despite numerous lighting solutions on the market and elsewhere, there remains a need for a single unit that addresses all of these issues.

SUMMARY OF THE INVENTION

The invention relates to a multi-functional, multi-mode portable decorative electronic illumination and optional magnifying device ("lighting device" or "device"). The lighting device incorporates at least two sets of light sources to provide perfect illumination for decorative lighting and for offering a separate ancillary illumination for spot lighting a specific area.

The lighting device described herein overcomes problems inherent in the prior art by providing a necessary and convenient, decorative functional two-way independent lighting device with at least two light sources, multiple settings and, potentially a magnifier. Indeed, although shown in the illustrated embodiment as a molded plastic table lamp with a magnifier, the device can be any shape, material and size, and may or may not include magnification.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
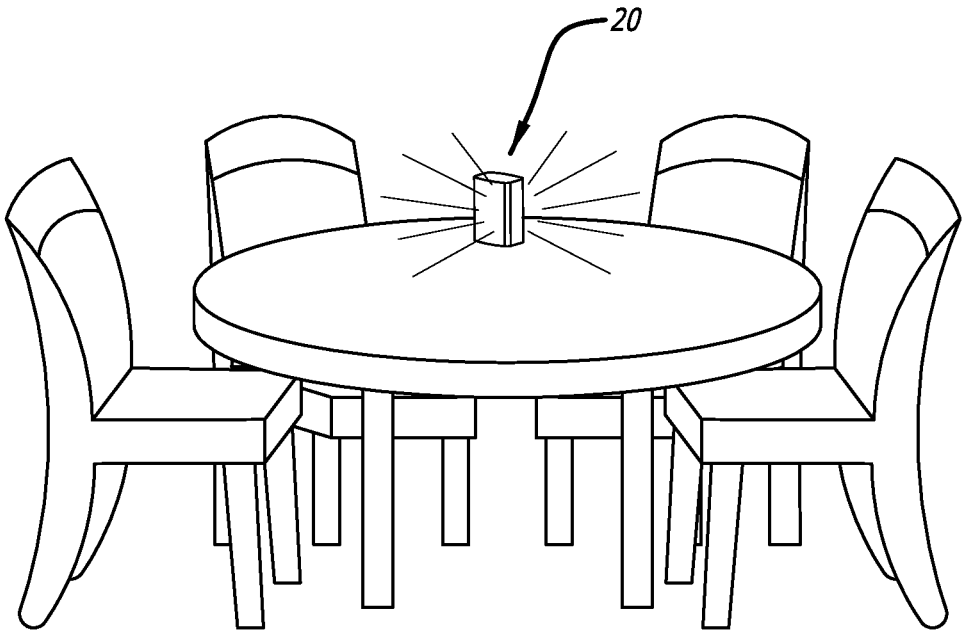
FIG. 1 is a perspective view of a portable dual mode lighting device of the present application placed on a dining table and shown in an area lighting mode.

Referring now to FIG. 1, a portable dual mode lighting device 20 of the present application is shown placed on a dining table in an area lighting mode. The lighting device 20 is especially well-suited for use at the dining table for both an area light and a spot light, depending on the need. Preferably, the lighting device 20 has sufficient power and luminosity to provide adequate area lighting to the people sitting around the dining table in a darkened room. Although the lighting device 20 is shown in a relatively compact, short configuration, which is well-suited for its dual-purpose as a spot light, it may also be taller or have accessories such as a shade or handle to facilitate movement around the table.

Figure 2:
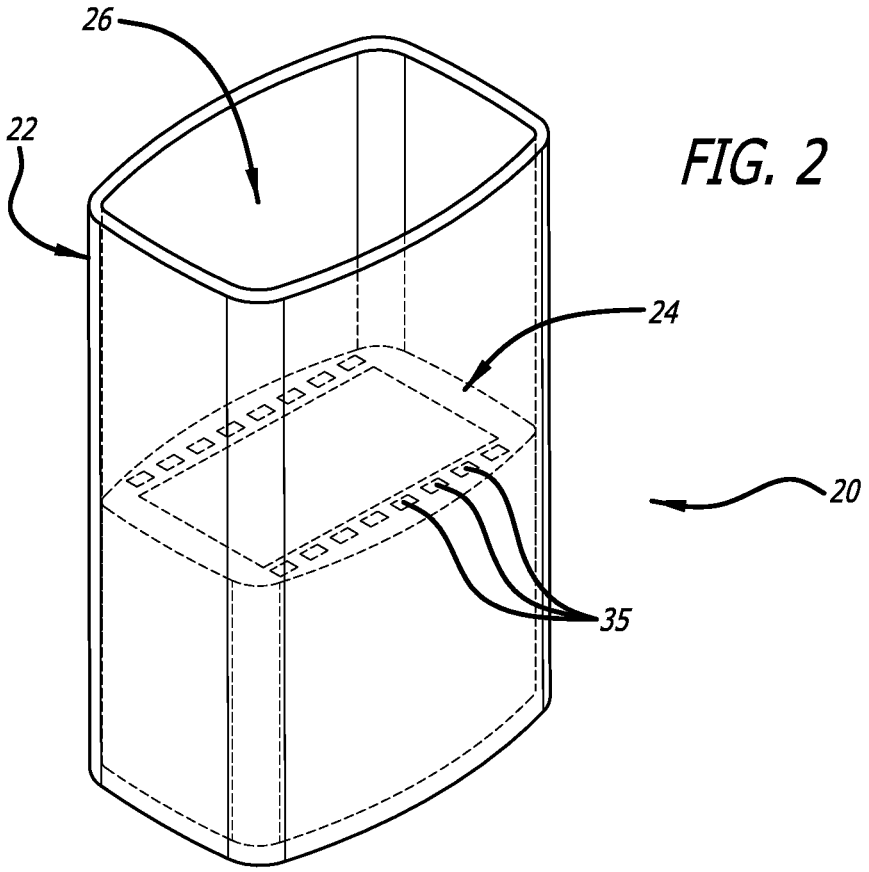
FIG. 2 is a perspective view from above of an exemplary embodiment of the dual-mode lighting device of the present application with an inner lighting unit shown in phantom through the walls of an outer housing.

FIG. 2 is a perspective view from above of the dual-mode lighting device 20 of the present application with an outer housing 22 and an inner lighting unit 24 shown in phantom through the walls thereof. In the illustrated embodiment, the outer housing 22 comprises a generally tubular form defining a vertical through bore 26 from top to bottom. As will be explained, the inner lighting unit 24 may have an exterior horizontal cross-section which matches an interior horizontal cross-section of the outer housing 22, and fits closely therein. For example, the horizontal cross-section of the outer housing 22 may be a rectangle with rounded corners as shown, with the inner lighting and 24 similarly shaped and sized. Desirably, the inner lighting unit 24 fits within a lower portion of the outer housing 22, both extending down to common lower edges so that both are supported by the surface on which the device is placed.

Figure 3:
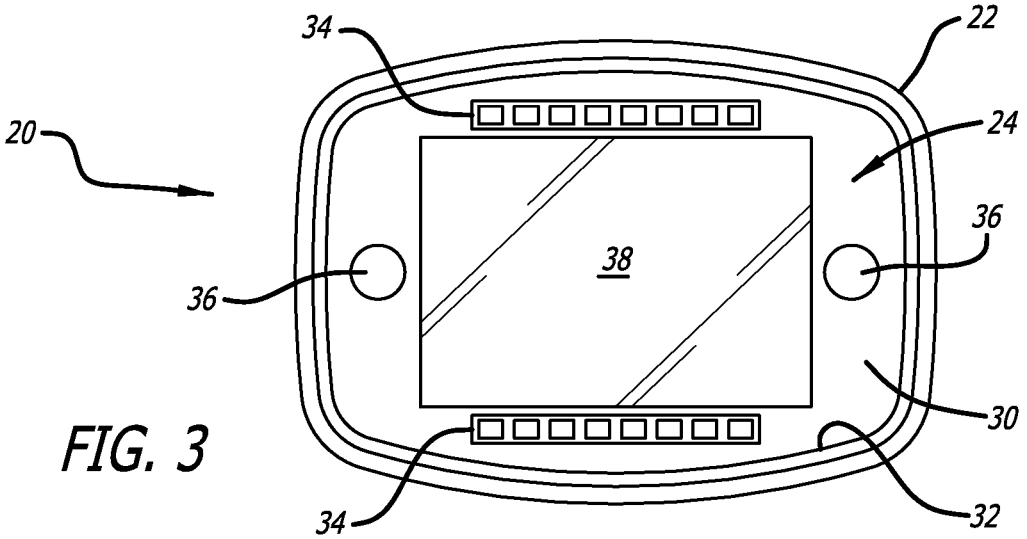
FIG. 3 is a bottom plan view of the lighting device.
Figure 4A:
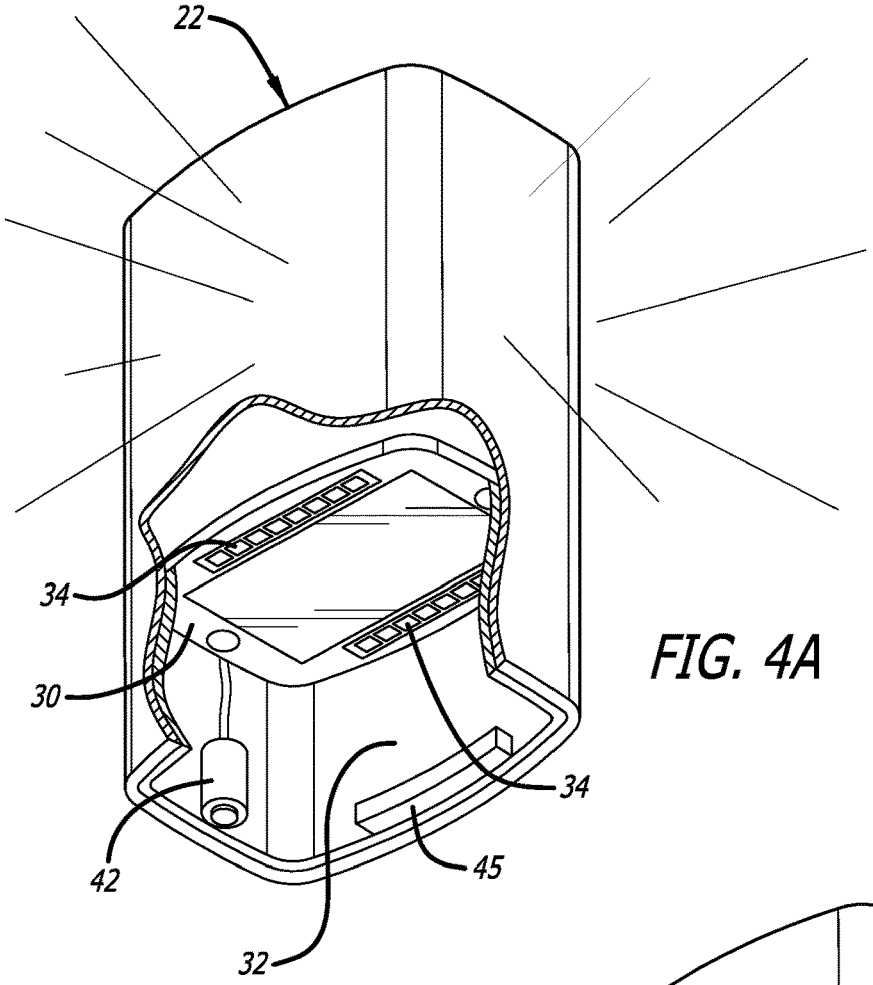
FIG. 4A is a perspective view looking up on the exemplary dual-mode lighting device with a portion of the outer housing cut away.
Figure 4B:
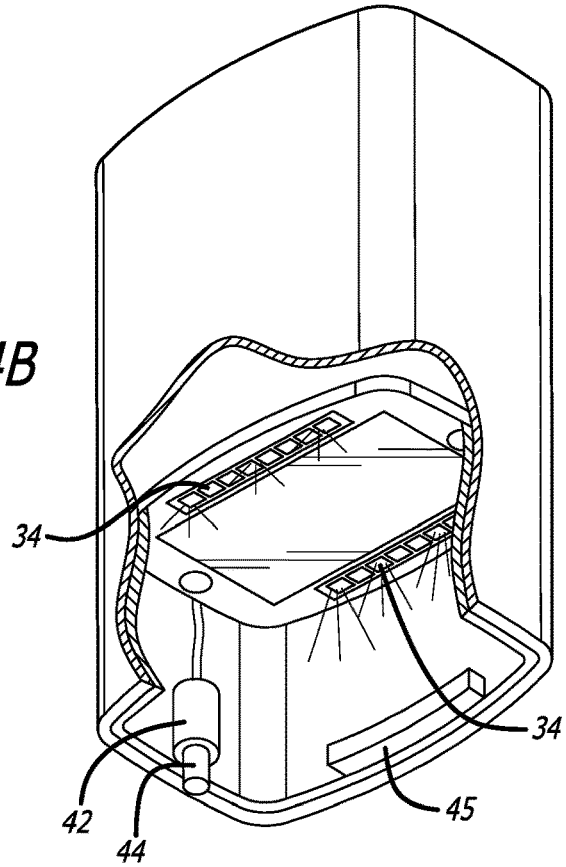
FIG. 4B is the same view showing actuation of a contact switch that changes the device between modes.

FIG. 3 is a bottom plan view of the lighting device 20. The inner lighting unit 24 may be configured as an inverted cup-shaped object with a horizontal plate 30 as a base supported at the top of a vertical wall 32. As seen in FIGS. 4A and 4B, the horizontal plate 30 is located midway up the through bore 26 of the outer housing 22. Both the outer housing 22 and the structural components of the inner lighting unit 24 may be formed of molded plastic, with the outer housing 22 being transparent or translucent so that light can easily passed therethrough.

With reference still to FIG. 3, a pair of rows of LEDs 34 extend in parallel along opposite sides of the horizontal plate 30, facing down. These LEDs 34 provide spot lighting for the device, as will be explained. Although LEDs are preferred for efficiency and minimal heat generation, other lighting sources may be utilized. FIG. 2 illustrates a pair of rows of LEDs 35 (or other lighting devices as explained) extending in parallel along opposite sides of the horizontal plate 30, facing up. That is, there are strips on both the top and bottom side of plate 30. The LEDs 35 are underneath and point down, while the LEDs 33 are on top and point up.

The unit 24 further includes one or more battery compartments 36 for receiving lightweight batteries. To ensure that the lighting device 20 is lightweight for maximum portability, the battery compartments 36 may be configured to receive small disk-shaped batteries such as size CR 2032 or CR 1616, for example, though AAA or even AA batteries also be used. The device should not be considered limited to one or the other light source or battery type. The batteries may be rechargeable and the unit 24 might also include a USB mini-USB or other port for charging. The unit battery might be rechargeable such as using a wireless charging station.

The horizontal plate 30 defines an inner opening in which a magnifying lens 38 is secured. In the illustrated embodiment, the magnifying lens 38 is rectangular and spans a majority of the cross-section of the plate 30. For example, the plate 30 may have a length of between 3-4 inches and the width of between 2-3 inches, with the magnifying lens 38 having dimensions that span between 50-80% of the area of the plate. For instance, the plate 30 has a length of 4 inches in width of 3 inches, with the magnifying lens having a length of 3 inches and a width of 2 inches. Because the outer housing 22 has a hollow vertical through bore 26, and the lighting unit 24 is formed in an inverted cup shape, the entire device 20 functions as a viewer of sorts with light passing from top to bottom through the magnifying lens 38.

It should be understood that the dual-mode lighting device 20 is portable and small enough to be placed unobtrusively on a standard dining table and lifted by hand, but is large enough to provide good area and spot lighting, and optionally, when looking through the device, to function as a viewer with or without the magnifying lens 38. The total height of the device 20 may be between 6-12 inches, while the horizontal size at least in one dimension is small enough to be grasped in the hand of an adult. For instance, the smallest horizontal dimension of the lighting device 20 is no more than 4 inches, more preferably between 2-3 inches, with a long horizontal dimension no more than 6 inches. The total weight of the device 20 should be small enough so that even small children can easily lift it, such as less than 2 pounds, and potentially less than 1 pound.

FIG. 4A is a perspective view looking up on the lighting device 20 with a portion of the outer housing 22 cut away. The device 20 has a switch for converting between area and spot lighting modes, or for turning both area and spot lighting modes on or off. For instance, a proximity or contact switch 42 mounts inside the vertical wall 32 of the inner lighting unit 24. The contact switch 42 is positioned at the lower edge of the device 20 to sense whether the device is placed on a surface such as a dining table or is elevated. FIG. 4B is the same view showing actuation of the contact switch 42 with a spring-biased piston 44 extended therefrom. That is, if the user lifts the device 20 up from the dining table, the piston 44 extends and changes between modes, or simply turns on the lower light source 34. Namely, FIG. 4A shows the device 20 in the area lighting mode when placed on a support surface such as a dining table, while FIG. 4B shows the device in the spot lighting mode when lifted up from the support surface, with the downwardly-facing LEDs 34 illuminated. Although a contact switch 42 is preferred, the switch 42 may also be a conventional manual switch mounted on the exterior of the outer housing 22.

In keeping with the portability and most common use as a table light, the power and intensity of the light sources 34, 35 should be within particular ranges. In the illustrated embodiment, both upper and lower light sources 34, 35 comprise two parallel series of eight LEDs each. The LEDs may each generate as little as 200 lumens of light, preferably warm yellow light, so that the entire assembly of lower light sources 34 generates at least 1600 lm, and likewise the assembly of upper light sources 35 generates at least 1600 lm. Each LED may generate between 200-500 lm of light. One option is to provide warm yellow light for the upper light sources 34, and a brighter daylight color for the LEDs in the lower light source 34 for better spot lighting. Furthermore, the use of LEDs is preferred to avoid excessive heat generation. Typical LEDs convert about 70% of the input energy into light, while the rest is dissipated in heat, whereas standard incandescent bulbs only convert about 10% of the energy used toward illumination. For instance, a relatively small 12 V LED bulb may generate about 9 W of light energy, and 4 W of heat energy. The lighting device 20 utilizes enough LED bulbs for good area and spot lighting, while avoiding excessive heat buildup. In one embodiment, the maximum temperature of the exterior of the outer housing 22 from prolonged use is limited to 70° F.

Also positioned within unit 24 may be weights 45 used as ballast to support the device from toppling over. For instance, the weights 45 may be strips adhered to the inside of opposite sides of the vertical wall 32.

Figure 5:
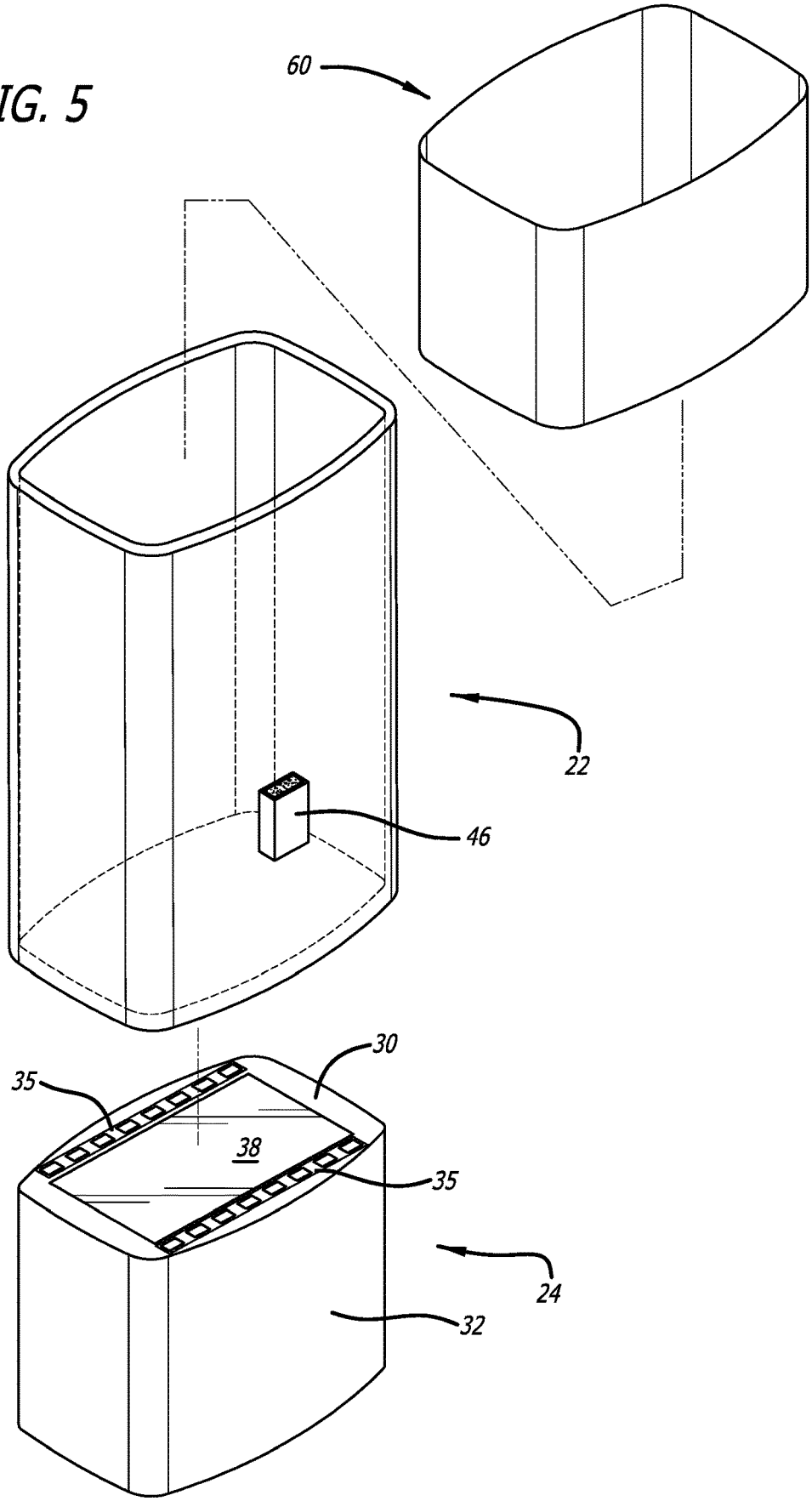
FIG. 5 is an exploded perspective view of the dual-mode lighting device with the outer housing above an inner lighting unit.

FIG. 5 is an exploded perspective view of the dual-mode lighting device 20 with the outer housing 22 above the inner lighting unit 24. The lighting unit 24 further includes a second pair of rows of LEDs 35 extending in parallel along opposite sides of the horizontal plate 30, facing up. The rows of LEDs 35 are desirably positioned along the long side of the magnifying lens 38, adjacent the outer housing 22. When the LEDs 35 are illuminated, they not only shine upward through the open upper mouth of the housing 22, but through the walls of the housing 22 which are either transparent or translucent in various colors.

The dual-mode lighting device 20 might also include a compartment for oils, such as those associated with aromatherapy, citronella candles as well as other oils. For example, FIG. 5 shows a small receptacle 46 secured to the outside of the outer housing 22, approximately at the height of the upper LEDs 35. Heat generated by the LEDs 35 may warm up and thus activate aromatherapy pods or other such items placed in the receptacle 46.

Figure 6A:
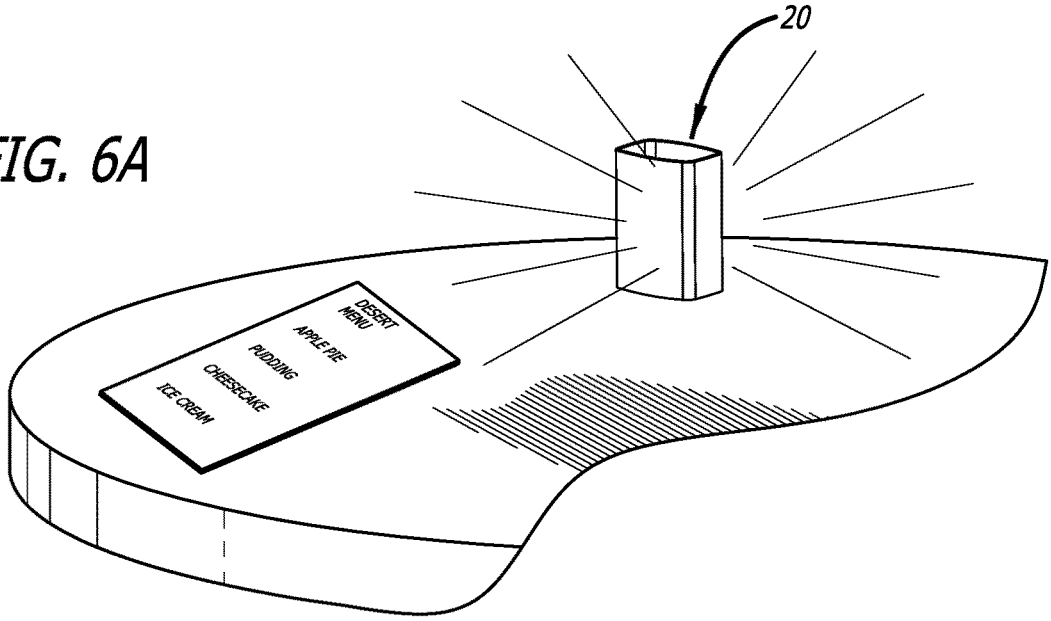
FIGS. 6A and 6B are schematic views of the dual-mode lighting device on a tabletop and shown in both area and spot lighting modes.
Figure 6B:
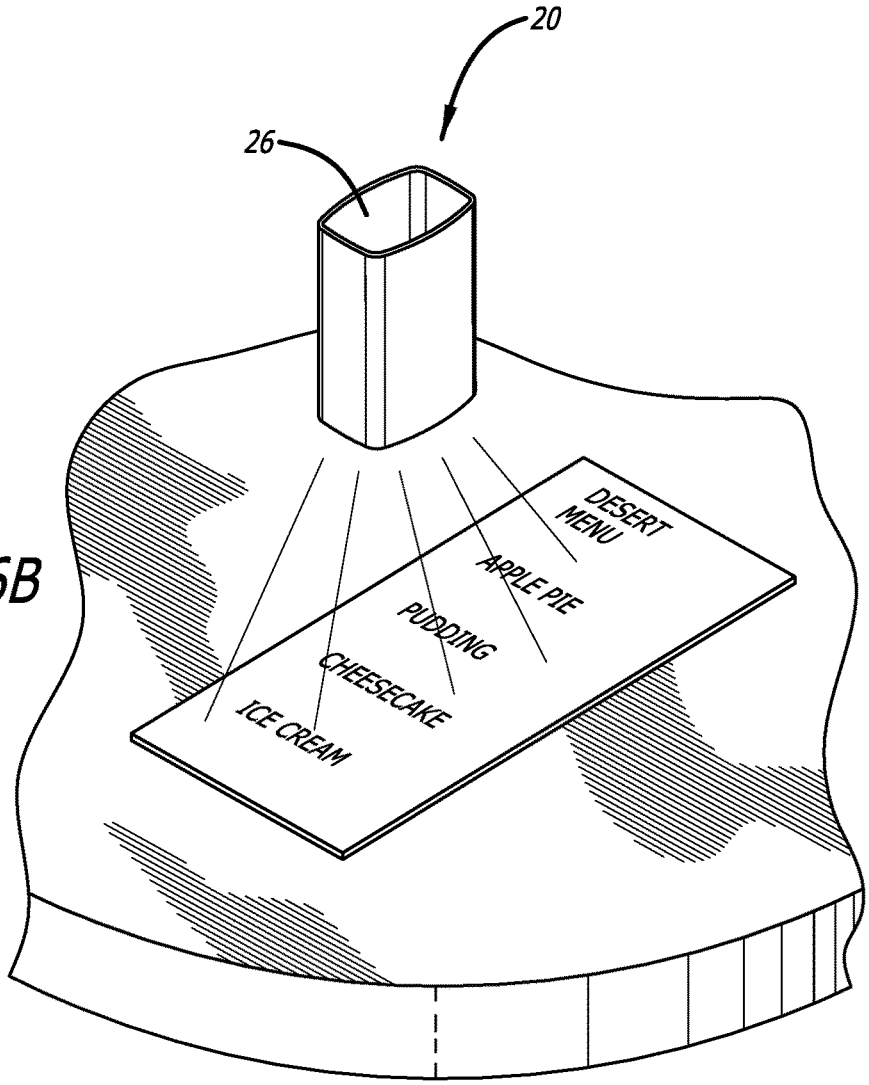

FIG. 6A is a schematic view of the dual-mode lighting device 20 placed on a tabletop in an area lighting mode. Conversely, FIG. 6B shows the device 20 lifted above the table in a spot lighting mode. Users can thus quickly lift the lighting device 20 to illuminate a menu on the table, and can further look through the device so that items on the menu are magnified.

The dual-mode lighting device 20 might also include an outer thin film sleeve 60 sized to closely surround the outer housing 22 and retain a thin sheet (not shown) such as an advertising placard insert that can be changed daily. That is, the sleeve 60 may be transparent, or may alternatively have printing thereon indicating instructions for use, or information such as menu items, specials, advertising, logos and the like.

Alternatives

The dual-mode lighting device 20 is designed so that the lighting unit 24 may be comprised of one or more separate compartments. The lighting unit 24 is designed to be fitted into the hollow outer housing 22 that may be translucent, opaque or made from any other material, which extends higher than the lighting unit 24. Alternatively, the lighting unit 24 may be attached to and supporting a hollow compartment so that the two compartments appear to be as one unit.

The lighting unit 24 is comprised of a power source, switches, one or more light sources such as light emitting diodes ("LED") casings, and an optional magnification lens. The lighting source is bi-directional so that it has the ability to illuminate in an upward direction ("Uplight") and the ability to illuminate in a downward direction ("Downlight"). An optional lens for magnification expanding across the length and width of the dual-mode lighting device 20 is housed between the upward and the downward illumination source. Other ancillary compartments may be incorporated based on design.

Uplight State:

The light source is powered and controlled through a coupled multi-switch mechanism. The dual-mode lighting device 20 may or may not include a photocell. If the dual-mode lighting device 20 does not contain a photocell, then a mechanical switch connected to the power source installed in the lighting unit 24 activates the device. The first state of illumination occurs when the mechanical switch is in the open position and any other operative trigger switch is in a closed position. This combination of mechanical open and operative trigger closed causes the Uplight to illuminate and the Downlight to fail to illuminate. If an optional photocell is installed on the device, the photocell will trigger illumination of the Uplight when the mechanical switch is in an open position and any operative trigger switch that controls power to the Downlight is in a closed position.

Downlight State:

The Downlight illumination occurs when the trigger switch is activated. If both the mechanical switch and the trigger switch are in an open position, the Downlight illuminates and the Uplight fails to illuminate. The trigger switch causes a disruption in the circuitry such that the Uplight fails to illuminate while causing the Downlight to illuminate. If a magnifying lens is present, the Downlight illuminates the object beneath the dual-mode lighting device 20 aiding a viewing of the magnified object. A third state of illumination occurs when the mechanical switch is in a closed state and the trigger switch is activated or in an open position. In this third state, the Downlight illuminates and the Uplight fails to illuminate.

The switches may provide additional settings to alternate the light intensity (low/high) to enable the user to carry out different tasks. Furthermore, the switch may provide for a setting (hibernation or ever ready) where other lighting sources light the device for easy retrieval in dark environments or wherein the Uplight and Downlight illuminate simultaneously.

The dual-mode lighting device 20 may be equipped with additional fashion and design elements, including but not limited to differing shapes, sizes, compartment designs and/or a handle of some sort. The dual-mode lighting device 20 may include additional lighting, inserts for advertisements, or other compartments.

The mechanical switch can be a push button switch or slide switch and/or any other means either physical or electronically controlled remotely to turn the Device on/off.

The trigger switch may be an electric solenoid type of capacitive touch switch, a piezo touch switch, resistance touch switch, photocell sensor, proximity switch and/or a pressure switch and/or any other physical or electronic means to trigger the lighting device.

The sleeve or upper compartment may include a hollow light-transmitting housing design whose walls can be of varying density, color and translucency constructed from plastic, glass, polycarbonate, bioplastic, resin, wood, bamboo or any other material.

The lower secondary compartment and base compartment include construction from polycarbonate, plastic, glass bioplastic, resin, wood, bamboo or any other material.

The power source may be any source of electrical current, including but not limited to, alkaline and/or water based battery, rechargeable and/or disposable battery, solar panel(s) and may or may not include a lightening connector or some other means for recharging and powering known or unknown.

The device shape may be unique, tubular, square, rectangle or any shape and size including but not limited to figurines.

The dual-mode lighting device 20 may be charged through USB port, battery, photocell, solar, wireless, with or without a charging station or any other means to supply power in a method now known or unknown.

The lighting magnifying lens is optional and comprised of a lens constructed from either glass, plastic, acrylic, polycarbonate, fresnel lens and/or other available material known and unknown.

Objects can be inserted inside the hollow through bore 26 and illuminated as on display.

The hollow outer housing 22 may be personalized with logos or names or provide a separate insert sleeve for placement of advertisements; the personalization can be in form of imprints, engravings, stickers or electronic monitor(s) or display(s) in forms now known or unknown.

The hollow outer housing 22 may be personalized with a separate sleeve and/or compartment for aromatherapy oils such as citronella.

The hollow outer housing 22 may be personalized with a separate sleeve and/or compartment for additional lighting such as decorative or otherwise.

The light can be of varying intensity and color, may be solid, flickering, pulsing or strobing.

Device functions that can be controlled remotely such as through an application. The lighting device 20 is safe for use indoor or outdoor. The lighting device 20 can be offered in a waterproof design. The magnifying lens can be replaced with another form of monitor or display mounted on any area of the Base or Hollow Compartment.

Placed on a surface the unit resembles a beautiful décor piece providing an ambiance of soft light. Once lifted, the ambient light turns off and the bottom, higher intensity light source is activated. Once placed back on a surface, the bottom light source is turned off and the ambient light is reactivated. Or, the ambient light is off but once lifted and held, the bottom light illuminates making it an invaluable readily accessible tool where the light intensity may be further adjusted to either high or low.

Inside the home, light is a necessary tool and it can set a mood. In an emergency, such as an earthquake and/or power outage we need light that is easily and readily available and accessible, not tucked in a drawer or closet that all too often needs to be located while panicked and/or disoriented in total darkness and whose batteries have died or are weak. But, on the nightstand beside the bed or out on a counter or table, the lighting device described herein is readily accessible. The mechanical switch can be set so that the device illuminates in low light intensity in the dark via fluorescent media or alternate LED light sources so that the device can easily be retrieved in dark environments. Thus, the device overcomes the problem that other flashlights have which often can't easily be seen or retrieved in the dark. The device can become the ideal nightstand companion in the middle of the night when we need light to search for our phone or we need to help guide us to the bathroom or kitchen for a drink and/or to a place of safety. Often, we have trouble locating our glasses to see or to read where the built-in magnifier comes handy.

The device can be adjusted in different décor and design elements to serve multiple uses in hotel rooms and offices.

Both the design incorporating the lighting unit 24 inserted into the Sleeve and the Sleeve attached atop the lighting unit 24 allows for simple design changes in color, translucency, lighting, personalization as well as potential advertising.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

It is claimed:

1. A portable dual-mode lighting device, comprising:

an outer housing having a transparent or translucent thin generally tubular wall having a horizontal cross-section between a bottom edge, a top edge, and having a hollow vertical through bore between the bottom edge and the top edge to enable a user to look straight through the outer housing from top to bottom;

an inner lighting unit positioned within the hollow through bore, the lighting unit having a horizontal plate positioned midway between the bottom edge and top edge of the outer housing, the plate having at least one first light source pointed up, and at least one second light source pointed down; and a switch attached to the housing or inner lighting unit and connected to a power source and to the first and second light sources, the switch being configured to detect when the bottom edge of the outer housing rests on a support surface, the switch turning on the first light source when the outer housing rests on a support surface to provide an area light and turning on the second light source when the outer housing is lifted up from the support surface to provide a spot light.

2. The lighting device of claim 1, wherein the first light source includes at least two rows of LEDs pointing up.

3. The lighting device of claim 2, wherein the second light source includes at least two rows of LEDs pointing down.

4. The lighting device of claim 3, further including a magnifying lens positioned in the horizontal plate, with the two rows of LEDs for both the first light source and the second light source with the rows in each light source arrayed on opposite sides of the magnifying lens between the magnifying lens and the outer housing.

5. The lighting device of claim 1, wherein the inner lighting unit is formed as an inverted cup-shaped object with vertical walls, and the switch is a contact switch mounted on an inside surface of the vertical walls.

6. The lighting device of claim 5, further including ballast secured to a lower edge of the device to help prevent the device from tipping over.

7. The lighting device of claim 5, further including a thin film sleeve sized to closely surround the outer housing for displaying information.

8. The lighting device of claim 1, wherein the switch is a contact switch located at the bottom edge of the outer housing.

9. The lighting device of claim 8, wherein the inner lighting unit is formed as an inverted cup-shaped object with vertical walls, and the contact switch is mounted on an inside surface of the vertical walls.

10. The lighting device of claim 1, wherein the outer housing is formed of a translucent thin wall such that the first light source shines through the thin wall to provide an area light.

11. The lighting device of claim 1, further including a receptacle mounted on an outer surface of the outer housing adjacent the first light source for receiving aromatherapy material or essential oils.

12. The lighting device of claim 1, wherein the outer housing has a horizontal rectangular cross-section with rounded corners, and the inner lighting unit has a similarly-sized and shaped horizontal cross-section, and further including a magnifying lens positioned in the horizontal plate, with two rows of LEDs for both the first light source and the second light source between the magnifying lens and the outer housing along a long dimension of the rectangular cross-section.

13. The lighting device of claim 1, wherein the generally tubular outer housing has a horizontal rectangular cross-section with rounded corners.

14. A portable dual-mode lighting device, comprising:

an outer housing having a transparent or translucent thin generally tubular wall with a horizontal cross-section between a bottom edge, a top edge, and a hollow vertical through bore between the bottom edge and the top edge;

an inner lighting unit positioned within the hollow through bore having a horizontal cross-section sized similar to the outer housing, the lighting unit having a horizontal plate positioned midway between the bottom edge and top edge of the outer housing, the plate having at least one first light source pointed up, and at least one second light source pointed down, wherein illumination of the first light source provides area lighting and illumination of the second light source provides downward spot lighting;

a magnifying lens positioned in the horizontal plate, with two rows of LEDs for both the first light source and the second light source being arrayed on opposite sides of the magnifying lens between the magnifying lens and the outer housing; and a switch attached to the housing or inner lighting unit and connected to a power source and to the first and second light sources, the switch being configured to alternately turn on the first light source or the second light source, or just turn on and off the second light source.

15. The lighting device of claim 14, wherein the switch is a contact switch located at the bottom edge of the outer housing.

16. The lighting device of claim 15, wherein the inner lighting unit is formed as an inverted cup-shaped object with vertical walls, and the contact switch is mounted on an inside surface of the vertical walls.

17. The lighting device of claim 14, further including a receptacle mounted on an outer surface of the outer housing adjacent the first light source for receiving aromatherapy material or essential oils.

18. The lighting device of claim 14, wherein the outer housing has a horizontal rectangular cross-section with rounded corners, and the inner lighting unit has a similarly-sized and shaped horizontal cross-section, and the two rows of LEDs for both the first light source and the second light source are located along a long dimension of the rectangular cross-section.

19. The lighting device of claim 14, further including ballast secured to a lower edge of the device to help prevent the device from tipping over.

20. The lighting device of claim 14, further including a thin film sleeve sized to closely surround the outer housing for displaying information.

* * * * *